US009454903B2

(12) United States Patent
Sobue et al.

(10) Patent No.: US 9,454,903 B2
(45) Date of Patent: Sep. 27, 2016

(54) ROAD INFORMATION SHARING METHOD, ROAD INFORMATION SHARING SYSTEM, ROAD INFORMATION SHARING DEVICE, AND ROAD INFORMATION SHARING PROGRAM

(71) Applicant: HITACHI, LTD., Tokyo (JP)

(72) Inventors: Tsuneo Sobue, Tokyo (JP); Tatsuaki Osafune, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 49 days.

(21) Appl. No.: 14/520,788

(22) Filed: Oct. 22, 2014

(65) Prior Publication Data

US 2015/0116135 A1 Apr. 30, 2015

(30) Foreign Application Priority Data

Oct. 29, 2013 (JP) ..... 2013-223819

(51) Int. Cl.

| | |
|---|---|
| ***G08G 1/123*** | (2006.01) |
| ***G08G 1/0968*** | (2006.01) |
| ***G08G 1/0969*** | (2006.01) |
| ***G08G 1/01*** | (2006.01) |

(52) U.S. Cl.

CPC ..... *G08G 1/096855* (2013.01); *G08G 1/0112* (2013.01); *G08G 1/0141* (2013.01); *G08G 1/0969* (2013.01)

(58) Field of Classification Search

CPC ..... G08G 1/096855; G08G 1/0969
USPC ..... 340/995.12, 905, 995.13, 995.19; 701/117, 119, 208, 209, 211; 348/148, 348/149

See application file for complete search history.

(56) References Cited

U.S. PATENT DOCUMENTS

| | | | | |
|---|---|---|---|---|
| 5,521,580 | A | 5/1996 | Kaneko et al. | |
| 7,440,842 | B1 * | 10/2008 | Vorona | G08G 1/0104 340/995.12 |
| 9,031,779 | B2 * | 5/2015 | Djugash | G01C 21/3415 701/425 |
| 2004/0209594 | A1 | 10/2004 | Naboulsi | |
| 2010/0001880 | A1 * | 1/2010 | Kraft, IV | G08G 1/096716 340/905 |
| 2013/0154854 | A1 * | 6/2013 | Chen | G08G 1/096741 340/905 |
| 2013/0253809 | A1 | 9/2013 | Jones et al. | |

(Continued)

FOREIGN PATENT DOCUMENTS

| | | | |
|---|---|---|---|
| EP | 2442291 | A1 | 4/2012 |
| JP | 2009-181472 | A | 8/2009 |
| WO | 2012104392 | A1 | 8/2012 |

OTHER PUBLICATIONS

Extended European Search Report received in corresponding European Application No. 14190848.3 dated Mar. 4, 2015.

*Primary Examiner* — Toan N Pham
(74) *Attorney, Agent, or Firm* — Mattingly & Malur, PC

(57) ABSTRACT

A road information sharing method according to the present invention is a road information sharing method for sharing the road information via a terminal device, the road information sharing method including the steps of storing sensor information acquired from a vehicle moving in accompaniment with the terminal device, detecting the road information from the sensor information on the basis of detection rules for detecting the road information, notifying a user about the road information detected, and prompting the user to make a judgment of necessity/unnecessity of registration about the detected road information, and storing the detected road information, if the detected road information is judged to be registration-necessary by the user.

14 Claims, 8 Drawing Sheets

(56) References Cited

U.S. PATENT DOCUMENTS

2014/0160295 A1* 6/2014 Kyomitsu ..... G08G 1/0112
348/159

2015/0334077 A1* 11/2015 Feldman ..... H04L 51/32
715/744

* cited by examiner

FIG. 3

104

| 301 ROAD INFORMATION | 302 SENSOR TYPE | 303 SENSOR INFORMATION ACQUISITION TIME-PERIOD | 304 DETECTION RULE |
|---|---|---|---|
| NEW ROAD | GPS SENSOR | 3 MINUTES | THE POSITION INFORMATION DEVIATES FROM THE ROAD LINK, AND AFTER MOVING FOR A WHILE ABOUT A PLACE OTHER THAN THE ROAD LINK, THE POSITION INFORMATION RIDES ON ANOTHER ROAD LINK |
| CLOSED TO TRAFFIC | GPS SENSOR | 60 SECONDS | THE POSITION INFORMATION MOVES ALONG THE ROAD LINK IN THE OPPOSITE DIRECTION IN A SHORT TIME |
| U-TURN AVAILABLE | GPS SENSOR | 60 SECONDS | THE POSITION INFORMATION MOVES ALONG THE ROAD LINK IN THE OPPOSITE DIRECTION IN A SHORT TIME |
| PARKING-LOT ENTRANCE | GPS SENSOR | 120 SECONDS | AFTER THE POSITION INFORMATION HAS DEVIATED FROM THE ROAD LINK, THE POSITION INFORMATION REMAINS UNCHANGED DURING A CONSTANT TIME-PERIOD |
| BYROAD | GPS SENSOR | 10 MINUTES | THE POSITION INFORMATION SHORTCUTS THE SCHEDULED ROUTE |
| DANGEROUS SPOT | ACCELERATION SENSOR OR GYRO SENSOR | 5 SECONDS | NEGATIVE ACCELERATION MORE THAN 0.2G GENERATES |

FIG. 4

106

| 401 DRIVING STATE | 402 SENSOR TYPE | 403 SENSOR INFORMATION ACQUISITION TIME-PERIOD | 404 ESTIMATION RULE |
|---|---|---|---|
| WAITING FOR SIGNAL CHANGE | GPS SENSOR | 5 SECONDS | THE POSITION INFORMATION REMAINS UNCHANGED IN PROXIMITY TO THE INTERSECTION POINT DURING 5 SECONDS |
| STOP AT PARKING LOT | GPS SENSOR | 10 SECONDS | AFTER THE POSITION INFORMATION HAS DEVIATED FROM THE ROAD LINK, THE POSITION INFORMATION REMAINS UNCHANGED DURING 10 SECONDS |
| SLOW DRIVING/ TRAFFIC CONGESTION | ACCELERATION SENSOR | 5 SECONDS | THE ACCELERATION IS LESS THAN A PREDETERMINE VALUE DURING A CONSTANT TIME-PERIOD |

FIG. 5

203

| 501 ROAD INFORMATION | 502 OCCURRENCE POSITION | 503 OCCURRENCE POINT-IN-TIME |
|---|---|---|
| NEW ROAD | (X1, Y1)–(X2, Y2)– ··· | 2013/7/24/ 15:27:36 |
| PARKING-LOT ENTRANCE | (X1, Y1) | 2013/7/24/ 13:11:05 |

ROAD INFORMATION SHARING METHOD, ROAD INFORMATION SHARING SYSTEM, ROAD INFORMATION SHARING DEVICE, AND ROAD INFORMATION SHARING PROGRAM

INCORPORATION BY REFERENCE

The present application claims priority from Japanese application JP 2013-223819 filed on Oct. 29, 2013, the content of which is hereby incorporated by reference into this application.

BACKGROUND OF THE INVENTION

The present invention relates to a road information sharing method, system, device, and program.

In the conventional technologies, as one of the methods for sharing between users the road information such as byroad, road closed to traffic for construction, and dangerous spot, there exists a method for automatically generating the road information, and sharing this information with another vehicle. For example, in JP-A-2009-181472, it is disclosed that, if, by a dangerous-state judgment unit, a vehicle is judged to be placed in a dangerous state that is included within a plurality of dangerous-state classifications determined in advance, predetermined danger information is transmitted to the outside within a transmission range corresponding to this dangerous state in which the vehicle is judged to be placed.

SUMMARY OF THE INVENTION

Namely, JP-A-2009-181472 discloses the method for automatically judging the dangerous state of a vehicle, and sharing with another vehicle the road information indicating that the vehicle is placed in the dangerous state. It is certain, however, that a noise (i.e., judgment failure) will be included in such a method. As a result, the certainty of the information becomes lowered. For example, there exist the following possibilities: The vehicle is judged to be in the dangerous state instead that it is not in the dangerous state actually; or conversely, the vehicle is judged not to be in the dangerous state instead that it is in the dangerous state actually. In view of this problem, the object of the present invention is to eliminate the noise caused by the judgment failure, and to enhance the certainty of the road information by prompting users to confirm the road information judged.

A road information sharing method according to the present invention is a road information sharing method in a road information sharing system for sharing road information, the road information sharing method including the steps of storing sensor information acquired from a terminal device or a vehicle moving in accompaniment with the terminal device, detecting road information from the sensor information on the basis of detection rules for detecting the road information, notifying a user about the road information detected, and prompting the user to make a judgment of necessity/unnecessity of the registration about the detected road information, and if the detected road information is judged to be registration-necessary by the user, storing or outputting to the outside the detected road information. Also, the road information sharing system according to the present invention is the road information sharing system for sharing road information in a center server via a terminal device, wherein the terminal device includes a sensor information storage unit for storing sensor information acquired from the terminal device or a vehicle, the vehicle moving in accompaniment with the terminal device, a road information detection-rules managing unit for managing detection rules for detecting the road information, a road information detecting unit for detecting the road information from the sensor information on the basis of the detection rules, a user notification unit for notifying a user about the road information detected, and prompting the user to make a judgment of necessity/unnecessity of registration about the detected road information, and a road information transmitting unit for transmitting the detected road information to the center server, if the detected road information is judged to be registration-necessary by the user notification unit, the center server including a road information storage unit for storing the road information received from the terminal device.

Moreover, a road information sharing device according to the present invention is a road information sharing device for sharing road information, the road information sharing device including a sensor information storage unit for storing sensor information acquired from a terminal device or a vehicle moving in accompaniment with the terminal device, a road information detection-rules managing unit for managing detection rules for detecting the road information, a road information detecting unit for detecting the road information from the sensor information on the basis of the detection rules, a user notification unit for notifying a user about the detected road information via the terminal device in order to prompt the user to make a judgment of necessity/unnecessity of registration about the detected road information, and a road information storage unit for storing the road information, if the detected road information is judged to be registration-necessary as a result of having notified the user about the detected road information.

Also, a road information sharing program according to the present invention is a road information sharing program for sharing road information, wherein the road information sharing program causes a computer to execute the steps of storing sensor information acquired from a terminal device or a vehicle moving in accompaniment with the terminal device, detecting the road information from the sensor information on the basis of detection rules for detecting the road information, notifying a user about the road information detected, and prompting the user to make a judgment of necessity/unnecessity of registration about the detected road information, and if the detected road information is judged to be registration-necessary by the user, storing or outputting the detected road information to the outside.

According to the present invention, it becomes possible to share between users the higher reliability road information.

Other objects, features and advantages of the invention will become apparent from the following description of the embodiments of the invention taken in conjunction with the accompanying drawings.

BRIEF DESCRIPTION OF THE DRAWINGS

FIG. 3 illustrates the table configuration of a road information detection-rules managing unit according to the present embodiment;

FIG. 4 illustrates the table configuration of a driving state estimation-rules managing unit according to the present embodiment;

FIG. 5 illustrates the table configuration of a road information storage unit according to the present embodiment;

DETAILED DESCRIPTION OF THE EMBODIMENT

Figure 1:
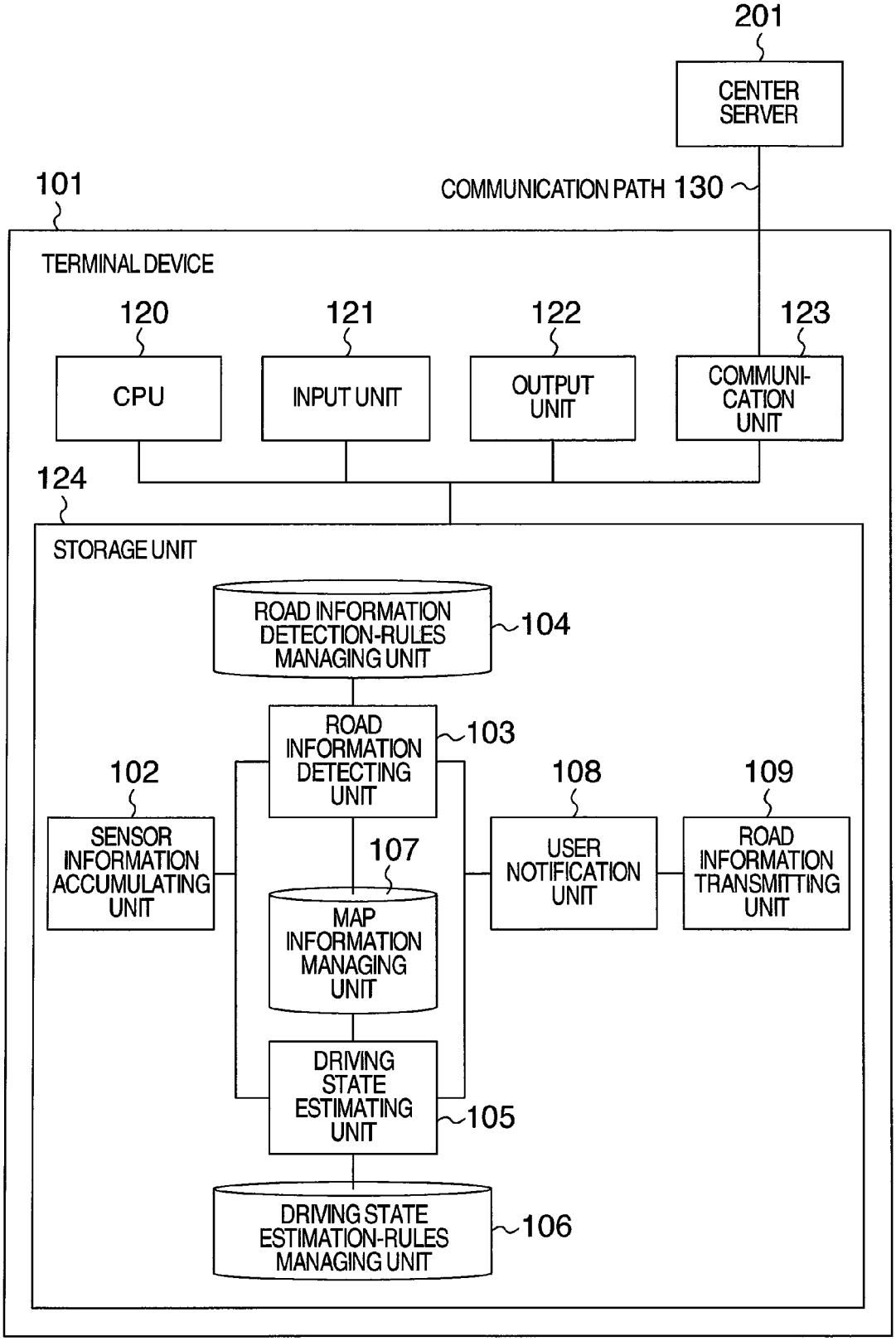
FIG. 1 illustrates the configuration of a road information sharing system according to the present embodiment.

A road information sharing method according to an embodiment of the present invention is a road information sharing method in a road information sharing system for sharing road information, the road information sharing method including the steps of storing sensor information acquired from a terminal device or a vehicle moving in accompaniment with the terminal device, detecting the road information from the sensor information on the basis of detection rules for detecting the road information, notifying a user about the road information detected, and prompting the user to make a judgment of necessity/unnecessity of registration about the detected road information, and if the detected road information is judged to be registration-necessary by the user, storing the detected road information or outputting to the outside. Here, the outside means an external device for storing the road information to be shared between the users. Such configuration makes it possible to enhance the reliability of the road information shared between the users via the terminal device. Also, the driving state of the vehicle is estimated from the sensor information on the basis of estimation rules for estimating the driving state of the vehicle moving in accompaniment with the terminal device. Next, based on the driving state estimated, it is judged whether or not the driving state is a state in which it is allowable to prompt the user to make the judgment of necessity/unnecessity of registration about the detected road information. Moreover, if the driving state is the state in which it is allowable to prompt the user to make the judgment of necessity/unnecessity of registration, the user is prompted to make the judgment of necessity/unnecessity of registration. Otherwise, if the driving state is not the state in which it is allowable to prompt the user to make the judgment of necessity/unnecessity of registration, the driving state is waited for to become the state in which it is allowable to prompt the user to make the judgment of necessity/unnecessity of registration, and then the user is prompted to make the judgment of necessity/unnecessity of registration. In this case, it becomes possible to enhance the reliability of the road information without imposing an excessive load onto the user who is driving the vehicle.

Also, if the road information is detected by a road information detecting unit, the user is notified about the detected road information. Simultaneously, if the driving state is judged to be the state in which it is allowable to prompt the user to make the judgment of necessity/unnecessity of registration, the user is prompted to make the judgment of necessity/unnecessity of registration. Otherwise, if the driving state is judged not to be the state in which it is allowable to prompt the user to make the judgment of necessity/unnecessity of registration, the user is notified that the user will be prompted to make the judgment of necessity/unnecessity of registration later. In this case, it becomes possible to smoothly proceed with the judgment of necessity/unnecessity of registration by notifying in advance that the road information has been detected. Furthermore, preferably, it is judged based on map information and the stored sensor information whether or not it should be performed to prompt the user to make the judgment of necessity/unnecessity of registration. Also, the following configuration is also allowable: The road information sharing method is so implemented as to execute the notification to the user in plural times, its first notification notifying the user about the detection of the road information by using a sound, its second notification notifying the user about information by using pop-up or image information, the information for prompting the user to make the judgment of necessity/unnecessity of registration about the detected road information. In this way, it becomes possible to reduce the load onto the user by displaying the image when prompting the user to make the judgment of necessity/unnecessity of registration, and by notifying by the voice in the other cases.

Also, the following configuration is also allowable. If the driving state changes from the state in which it is allowable to prompt the user to make the judgment of necessity/unnecessity of registration to the state in which it should not prompt the user to do so, an image is controlled so as not to display for prompting the user to make the judgment of necessity/unnecessity of registration. Also, the following configuration is also allowable. If the plural pieces of road information are detected, the user is notified about the detected plural pieces of road information in accordance with priority degrees being assigned to the plural pieces of road information on the basis of respective detection points-in-time or respective distances between the detection locations and the present positions.

Next, a road information sharing system according to an embodiment of the present invention is a road information sharing system for sharing road information in a center server via a terminal device, wherein the terminal device includes a sensor information storage unit for storing sensor information acquired from the terminal device or a vehicle moving in accompaniment with the terminal device, a road information detection-rules managing unit for managing detection rules for detecting the road information, a road information detecting unit for detecting the road information from the sensor information on the basis of the detection rules, a user notification unit for notifying a user about the road information detected, and prompting the user to make a judgment of necessity/unnecessity of registration about the detected road information, and a road information transmitting unit for transmitting the detected road information to the center server, if the detected road information is judged to be registration-necessary by the user notification unit, the center server including a road information storage unit for storing the road information received from the terminal device. Such configuration makes it possible to enhance the reliability of the road information shared between the users.

Also, the terminal device further includes a driving state estimation-rules managing unit for managing estimation rules for estimating the driving state of the vehicle moving in accompaniment with the terminal device, and a driving state estimating unit for estimating the driving state of the vehicle from the sensor information on the basis of the estimation rules, the user notification unit judging, based on the driving state estimated, whether or not the driving state is a state in which it is allowable to prompt the user to make the judgment of necessity/unnecessity of registration about the detected road information. Moreover, if the driving state is the state in which it is allowable to prompt the user to make the judgment of necessity/unnecessity of registration, the user notification unit prompts the user to make the judgment of necessity/unnecessity of registration. Otherwise, if the driving state is not the state in which it is allowable to prompt the user to make the judgment of necessity/unnecessity of registration, the user notification unit waits for the driving state to become the state in which it is allowable to prompt the user to make the judgment of necessity/unnecessity of registration, and then prompts the user to make the judgment of necessity/unnecessity of registration. In this case, it becomes possible to enhance the reliability of the road information without imposing an excessive load on the user who is driving the vehicle.

Also, if the road information is detected by the road information detecting unit, the user notification unit notifies the user about the detected road information. Simultaneously, if the driving state is judged to be the state in which it is allowable to prompt the user to make the judgment of necessity/unnecessity of registration by the driving state estimating unit, the user notification unit prompts the user to make the judgment of necessity/unnecessity of registration. Otherwise, if the driving state is judged not to be the state in which it is allowable to prompt the user to make the judgment of necessity/unnecessity of registration by the driving state estimating unit, the user notification unit notifies the user that the user will be prompted to make the judgment of necessity/unnecessity of registration later. In this case, it becomes possible to smoothly implement the judgment of necessity/unnecessity of registration by notifying in advance that the road information has been detected.

Next, a road information sharing device according to an embodiment of the present invention is a road information sharing device for sharing road information, the road information sharing device including a sensor information storage unit for storing sensor information acquired from a terminal device or a vehicle moving in accompaniment with the terminal device, a road information detection-rules managing unit for managing detection rules for detecting the road information, a road information detecting unit for detecting the road information from the sensor information on the basis of the detection rules, a user notification unit for notifying a user about the detected road information via the terminal device in order to prompt the user to make a judgment of necessity/unnecessity of registration about the detected road information, and a road information storage unit for storing the road information, if the detected road information is judged to be registration-necessary as a result of having notified the user about the detected road information. Such configuration makes it possible to enhance the reliability of the road information shared between the users. Also, the road information sharing device further includes a driving state estimation-rules managing unit for managing estimation rules for estimating the driving state of the vehicle moving in accompaniment with the terminal device, and a driving state estimating unit for estimating the driving state of the vehicle from the sensor information on the basis of the estimation rules, the user notification unit judging, based on the driving state estimated, whether or not the driving state is a state in which it is allowable to prompt the user to make the judgment of necessity/unnecessity of registration about the detected road information.

Furthermore, if the driving state is the state in which it is allowable to prompt the user to make the judgment of necessity/unnecessity of registration, the user notification unit prompts the user to make the judgment of necessity/unnecessity of registration. Otherwise, if the driving state is not the state in which it is allowable to prompt the user to make the judgment of necessity/unnecessity of registration, the user notification unit waits for the driving state to become the state in which it is allowable to prompt the user to make the judgment of necessity/unnecessity of registration, and then notifies the user that the user will be prompted to make the judgment of necessity/unnecessity of registration. In this case, it becomes possible to enhance the reliability of the road information without imposing an excessive load to the user who is driving the vehicle.

Also, a road information sharing program according to an embodiment of the present invention is a road information sharing program for sharing road information, wherein the road information sharing program causes a computer to execute the steps of storing sensor information acquired from a terminal device or a vehicle moving in accompaniment with the terminal device, detecting the road information from the sensor information on the basis of detection rules for detecting the road information, notifying a user about the road information detected, and prompting the user to make a judgment of necessity/unnecessity of registration about the detected road information, and storing the detected road information, or outputting the detected road information to the outside, if the detected road information is judged to be registration-necessary by the user. Here, the outside means an external device for storing the road information to be shared between the users. Such configuration makes it possible to enhance the reliability of the road information shared between the users via the terminal device.

Hereinafter, referring to the drawings, the detailed explanation will be given below concerning embodiments of the present invention.

FIG. 1 illustrates the configuration of a road information sharing system in the present embodiment. This road information sharing system includes a terminal device 101 and a center server 201. The terminal device 101 may be an information terminal device such as a smartphone or a tablet terminal, or may be a navigation device to be mounted on a vehicle. The terminal device 101 and the center server 201 are connected to each other via a communications path 130. The communications path 130 may be a mobile network, or a wireless communications path such as wireless LAN.

The terminal device 101 includes a CPU (Central Processing Unit) 120, an input unit 121, an output unit 122, a communication unit 123, and a storage unit 124. The storage unit 124, which is a device such as semiconductor memories or HDD (Hard Disk Drive), stores programs and data therein. The CPU 120 executes the processing of the terminal device 101 on the basis of the programs and data stored in the storage unit 124. The input unit 121 detects operations performed by the user. The output unit 122 displays an image, or makes a sound in accordance with the instruction from the CPU 120. The communication unit 123 performs the communication with the center server 201.

Here, an explanation will be given regarding the storage unit 124. The storage unit 124 stores a program and/or data for implementing each of the following configuration components: a sensor information accumulating unit 102, a road information detecting unit 103, a road information detection-rules managing unit 104, a driving state estimating unit 105, a driving state estimation-rules managing unit 106, a map information managing unit 107, a user notification unit 108, and a road information transmitting unit 109. The respective processing that will be explained hereinafter is implemented in such a manner that the CPU 120 executes the respective program stored in the storage unit 124. Incidentally, these programs may be stored into a computer-readable memory medium, and may be installed into the terminal device 101 from this memory medium.

The sensor information accumulating unit 102 accumulates sensor information by collecting this sensor information periodically. Here, this sensor information is acquired from a (not-illustrated) built-in sensor that is built in the terminal device 101. The sensor information accumulating unit 102 manages the history of the sensor information in the number determined in advance, such as, e.g., the amount of one hour or one day. The acquisition time-period of the sensor information to be accumulated may be determined using the time or data amount. Also, the upper-limit value of the sensor information to be accumulated may be fixedly set in advance, or the upper-limit value may be configured so as to be changed by the center server 201. The type of the built-in sensor built in the terminal device 101 is GPS (Global Positioning System) sensor, acceleration sensor, gyro sensor, temperature sensor, luminance sensor, or the like. Also, not only the sensor information acquired from the built-in sensor built in the terminal device 101 but also sensor information acquired from the outside via communications may be accumulated. For example, the communication connection with the vehicle may be established, and the control information (i.e., vehicle's speed, engine's rotation number, and the like) may be acquired and accumulated. Also, for example, a sensor may be affixed to the user, and the user's heart rate and the like may be collected and accumulated.

The road information detecting unit 103 detects the road information from the history of the sensor information accumulated into the sensor information accumulating unit 102. Moreover, the user notification unit 108 presents the detected road information to the user, thereby prompting the user to confirm the road information. If the road information is instructed explicitly so as to be registered by the user, the road information is transmitted to the center server 201 by the road information transmitting unit 109, then being accumulated into the center server 201. Incidentally, when the user notification unit 108 presents the traffic information to the user, the driving state estimating unit 105 confirms the driving state of the user, thereby judging whether or not the driving state is a state in which it is allowable to present the road information to the user. Then, if the driving state is not the state in which it is allowable to present the road information to the user, the user notification unit 108 waits for the driving state to become the state in which it is allowable to present the road information, and then presents the road information to the user. The map information managing unit 107 manages the following map information: road link information indicating road's position and shape, intersection related information (coordinate, lane information (such as presence or absence of right-turn exclusive lane), direction sign, and the like), information about address, facilities, telephone number, and the like, and map information becoming necessary for car navigation. Also, the map information managing unit 107 manages information set by the user, such as user's home position and vehicle's driving-schedule route. These pieces of map information are utilized for the detection of the road information in the road information detecting unit 103, and the estimation of the driving state in the driving state estimating unit 105.

Figure 2:
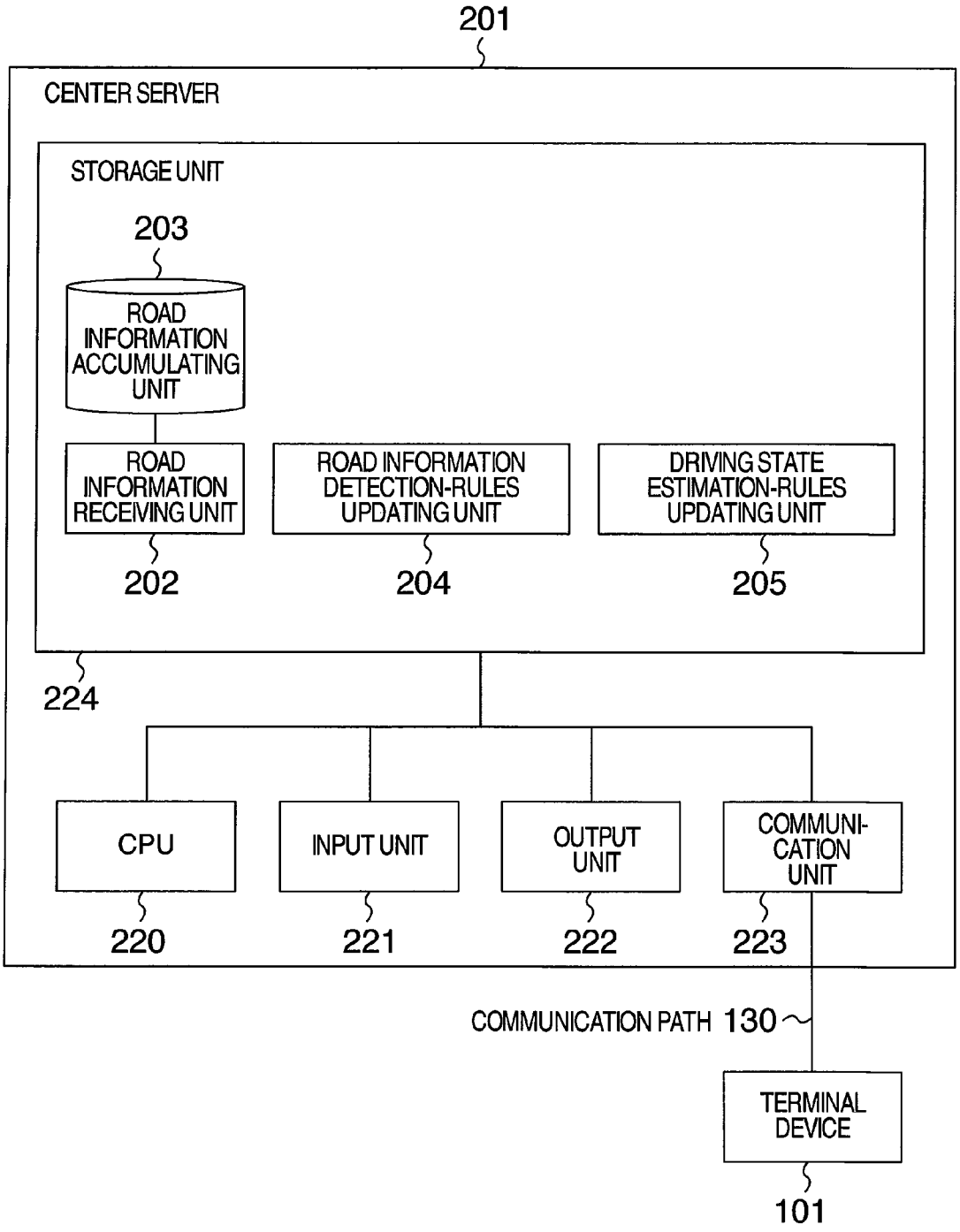
FIG. 2 illustrates the configuration of a center server according to the present embodiment.

Next, FIG. 2 illustrates the specific configuration of the center server 201. The center server 201 includes a CPU 220, an input unit 221, an output unit 222, a communication unit 223, and a storage unit 224. The storage unit 224, which is a device such as semiconductor memories or HDD, stores programs and data therein. The CPU 220 executes processings on the basis of the programs and data stored in the storage unit 224. When updating road information detection rules or driving state estimation rules, the input unit 221 detects an operation of the center server 201 performed by the user, then outputting this operation as the input information. Also, the output unit 222 displays an image, or makes a sound in accordance with the instruction from the CPU 220, thereby prompting the user to make the confirmation. The communications unit 223 is connected to the communication unit 123 of the terminal device 101 via the communications path 130. In this way, the communication unit 223 performs communication with the terminal device 101.

The storage unit 224 stores a program and/or data for implementing each of the following configuration components: a road information receiving unit 202, a road information accumulating unit 203, a road information detection-rules updating unit 204, and a driving state estimation-rules updating unit 205. The respective processing that will be explained hereinafter is implemented in such a manner that the CPU 220 executes the respective program stored in the storage unit 224. Incidentally, these programs may be stored into a computer-readable storage medium, and may be installed into the center server 201 from this memory medium.

The road information receiving unit 202 accumulates information into the road information accumulating unit 203. Here, this information is constituted from the road information, the occurrence position, and the occurrence point-in-time in a manner of being caused to correspond to each other. Also, the road information is transmitted from the road information transmitting unit 109 of the terminal device 101. Based on this information accumulated into the road information accumulating unit 203, the traffic information to be delivered to another vehicle is delivered thereto, and is shared therebetween. The delivery of the traffic information to another vehicle may be performed as follows: The entire information registered into the road information accumulating unit 203 may be delivered; or the plural pieces of road information that have occurred at proximate locations may be delivered after being merged with each other; or only the traffic information whose type has been determined in advance may be delivered; or the traffic information to be delivered may be changed depending on the time-zone or the like.

The road information detection-rules updating unit 204 updates, from the center server, the road information detection rules managed in the road information detection-rules managing unit 104 of the terminal device 101. The detection rules are detection rules utilized in the road information detecting unit 103 in order to detect the road information. Also, the driving state estimation-rules updating unit 205 updates, from the center server, the driving state estimation rules managed in the driving state estimation-rules managing unit 106 of the terminal device 101. The estimation rules are estimation rules utilized in the driving state estimating unit 105 in order to judge whether or not the driving state is the state in which it is allowable to prompt the user to confirm the road information. As regards the road information detection rules and the driving state estimation rules, the delivery may be performed as follows: One and the same estimation rule may be delivered from the center server to all of the terminal devices 101; or an estimation rule corresponding to each local area may be delivered on each local-area basis from the center server; or the estimation rules may be optimized in harmony with the ways in which the users drive the vehicles, and estimation rules different from each other on each user basis may be delivered from the center server. Also, the update timings for the estimation rules of the road information detection-rules managing unit 104 and the driving state estimation-rules managing unit 106 may be implemented as follows: An inquiry may be automatically made about the update from the terminal device 101 to the center server 201 periodically; or the inquiry may be made to the center server 201 with a timing that is explicitly instructed by the user using a button pushing or the like.

FIG. 3 illustrates the table configuration of the road information detection-rules managing unit 104 of the terminal device 101. This table is a table for managing the detection rules for detecting the road information from the sensor information and the map information. This table is constituted from road information 301, sensor type 302, sensor information acquisition time-period 303, and detection rule 304. The road information 301 indicates road information that becomes the detection targets. The sensor type 302 indicates the types of sensors that become necessary for detecting the road information. The sensor information acquisition time-period 303 indicates time-periods during which the sensor information utilized for detecting the road information is acquired. The detection rule 304 indicates a method for detecting the road information using the sensors indicated by the sensor type 302. For example, in order to detect "new road" that is not described on the map, it is advisable just to detect that the position information on the terminal device 101 deviates from the road link and moves, and restores back to another road link. On account of this, the detection rule 304 turns out to be a rule that "the position information deviates from the road link, and after moving for a while about a place other than the road link, the position information rides on another road link". The sensor type 302 that becomes necessary therefor turns out to be "GPS sensor".

Here, "the road link" described in the detection rule 304 is map information, and can be acquired from the map information managing unit 107. Also, in order to detect "closed to traffic", it is advisable just to detect that the position information on the terminal device 101 moves along the road link in the opposite direction in a short time. Moreover, in order to detect "U-turn available", similarly to the case where "closed to traffic" is detected, it is advisable just to detect that the position information on the terminal device 101 moves along the road link in the opposite direction in a short time. Here, by taking into consideration the information acquired from a plurality of terminal devices 101, it becomes possible to make a distinction between "closed to traffic" and "U-turn available". For example, the following method is conceivable for the distinction: If the above-described detection rule holds in all of the terminal devices that will pass through this road link during a certain constant time-period (time), the road information is judged to be the "closed to traffic". Meanwhile, if the above-described detection rule holds only in some of the terminal devices, the road information is judged to be the "U-turn available".

Next, in order to detect "parking-lot entrance", it is advisable just to detect that the position information on the terminal device 101 remains unchanged during a constant time-period, after the position information has deviated from the road link. Also, in order to detect "byroad", it is advisable just to detect that the position information on the terminal device 101 shortcuts the scheduled route (i.e., road link). Namely, if it is detected that the position information moves along a road link not included in the scheduled route, and joins the scheduled route again, the road information can be estimated to be "byroad". Also, in order to detect "dangerous spot", it is advisable just to utilize the information acquired from the acceleration sensor or gyro sensor of the terminal device 101. For example, if it is detected that a negative acceleration of 0.2 G or more has occurred, it is judged that a sudden braking has been applied. Accordingly, the road information can be judged to be the "dangerous spot". In this case, the necessary sensor type 302 turns out to be "acceleration sensor" or "gyro sensor".

FIG. 4 illustrates the table configuration of the driving state estimation-rules managing unit 106 of the terminal device 101. This table is a table for managing the estimation rules for estimating the driving states from the sensor information and the map information. This table is constituted from driving state 401, sensor type 402, sensor information acquisition time-period 403, and estimation rule 404. The driving state 401 indicates driving states that become the detection targets. The sensor type 402 indicates the types of sensors that become necessary for estimating the driving states. The sensor information acquisition time-period 403 indicates time-periods during which the sensor information utilized for estimating the driving states is acquired. The detection rule 404 indicates a method for estimating the driving states using the sensors indicated by the sensor type 402. This method means that, if the estimation rule 404 is satisfied, it is in the driving state 401. For example, if the vehicle stops (=the position information remains unchanged) in proximity to an intersection point, the driving state can be estimated to be a state of "waiting for signal change". On account of this, the estimation rule 404 for which the driving state 401 is the "waiting for signal change" turns out to be a rule that "the position information remains unchanged in proximity to the intersection point during a constant time-period", and the sensor type 302 that becomes necessary therefor turns out to be "GPS sensor". Here, the coordinate information on "the intersection point" described in the estimation rule 404 can be acquired from the map information managing unit 107. Accordingly, in this case, the driving state is the state of "waiting for signal change" in which the position information remains unchanged. Consequently, this driving state is judged to be the state in which it is allowable to present the road information to the user.

Also, in order to estimate "stop at parking lot", it is advisable just to detect that the position information on the terminal device 101 remains unchanged during a constant time-period, after the position information has deviated from the road link. Accordingly, in this case, the driving state is the state of "stop at parking lot" in which the position information remains unchanged, either. Consequently, this driving state is also judged to be the state in which it is allowable to present the road information to the user. Furthermore, in order to estimate "slow driving/traffic congestion", it is advisable just to detect that, for example, the acceleration is less than a predetermine value. Accordingly, in this case, the driving state is the state of "slow driving/traffic congestion" in which the change in the position information is less than the predetermine value. Consequently, the driving state is judged to be the state in which it is allowable to present the road information to the user. In this way, the driving states to be memorized into the above-described table are the driving states (such as the "waiting for signal change" and the "stop at parking lot") in which it is allowable to attract the user's attention. Namely, these driving states are the states in which it is allowable to prompt the user to confirm the road information (i.e., the states in which it is allowable to prompt the user to make the judgment of necessity/unnecessity of registration about the road information).

FIG. 5 illustrates the table configuration of the road information accumulating unit 203 of the center server 201. This table is a table for managing the road information received from the terminal device 101. This table is constituted from road information 501, occurrence position 502, and occurrence point-in-time 503 in a manner of being caused to correspond to each other. The occurrence position 502 indicates occurrence positions of the road information 501. As the occurrence positions, there exist an occurrence position represented by the line-segment (i.e., point string) like "new road", and an occurrence position represented by the points like "parking-lot entrance". The occurrence point-in-time 503 indicates occurrence the points-in-time at which the road information 501 has occurred.

Figure 6:
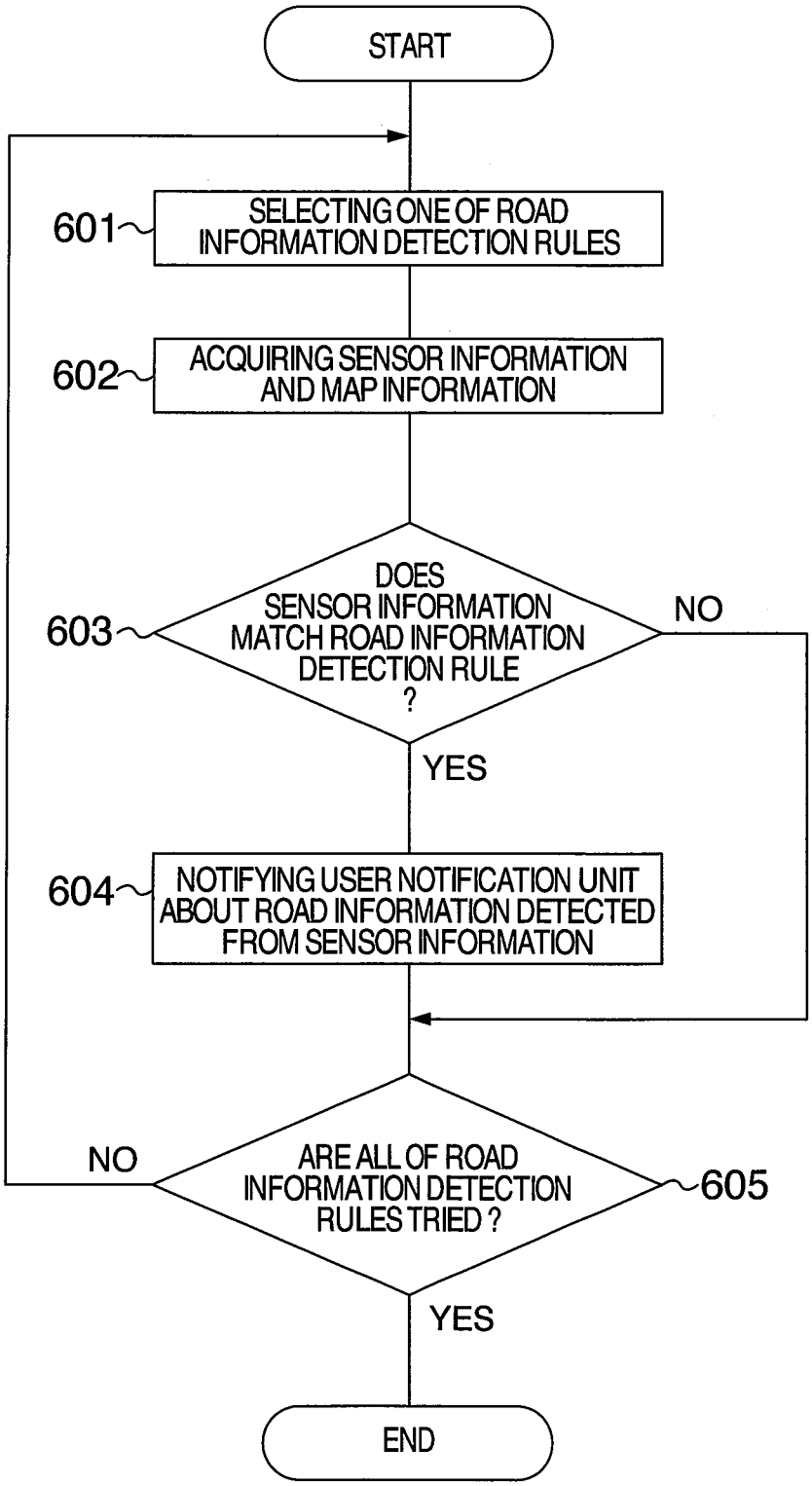
FIG. 6 illustrates the processing flow performed by a road information detecting unit according to the present embodiment.

FIG. 6 illustrates a processing flow performed by the road information detecting unit 103 of the terminal device 101. First of all, at a step 601, at the time of starting the processing application, or for each lapse of a constant time-period, the road information detecting unit 103 acquires one of the road information detection rules managed by the road information detection-rules managing unit 104. Next at a step 602, the unit 103 acquires the sensor information and map information, which become necessary for detecting the road information. Concretely, first, based on the sensor type 302 and sensor information acquisition time-period 303 corresponding to the road information detection rule acquired at the step 601, the unit 103 accesses the sensor information accumulating unit 102, thereby acquiring the sensor information therefrom. Here, together with the sensor information, the unit 103 acquires GPS point-in-time information and GPS position information as well from the sensor information accumulating unit 102. This is performed in order to identify the occurrence point-in-time and the occurrence position of the road information. Also, the unit 103 accesses the map information managing unit 107, thereby acquiring the map information therefrom. For example, if, at the step 601, the unit 103 has acquired the detection rule of "new road", the unit 103 acquires, from the sensor information accumulating unit 102, the GPS position information by the amount of 3 minutes, and acquires, from the map information managing unit 107, the road link information that becomes necessary for detecting the road information.

Next, at a step 603, the unit 103 judges whether or not the sensor information acquired at the step 602 satisfies the road information detection rule. If the sensor information satisfies the detection rule (Yes), the unit 103 proceeds to a step 604. Meanwhile, if the sensor information does not satisfy the detection rule (No), the unit 103 proceeds to a step 605. At the step 604, the unit 103 notifies the user notification unit 108 about the road information detected from the sensor information. When notifying the user notification unit 108, the unit 103 passes not only the detected road information but also the occurrence point-in-time and the occurrence position as additional information. The occurrence point-in-time can be identified from the GPS point-in-time information when the detection rule is satisfied, and the occurrence position can be identified from the GPS position information when the detection rule is satisfied. At the step 605, the unit 103 confirms whether or not all of the road information detection rules managed by the road information detection-rules managing unit 104 have been confirmed. If all of the road information detection rules have been confirmed, the unit 103 ends the processing. Meanwhile, if an unconfirmed road information detection rule still exists, the unit 103 returns to the step 601. Since the road information detection rules such as the "new road", "closed to traffic", and "U-turn available" are independent of each other, a plurality of detection rules can be satisfied in a short time.

Figure 7:
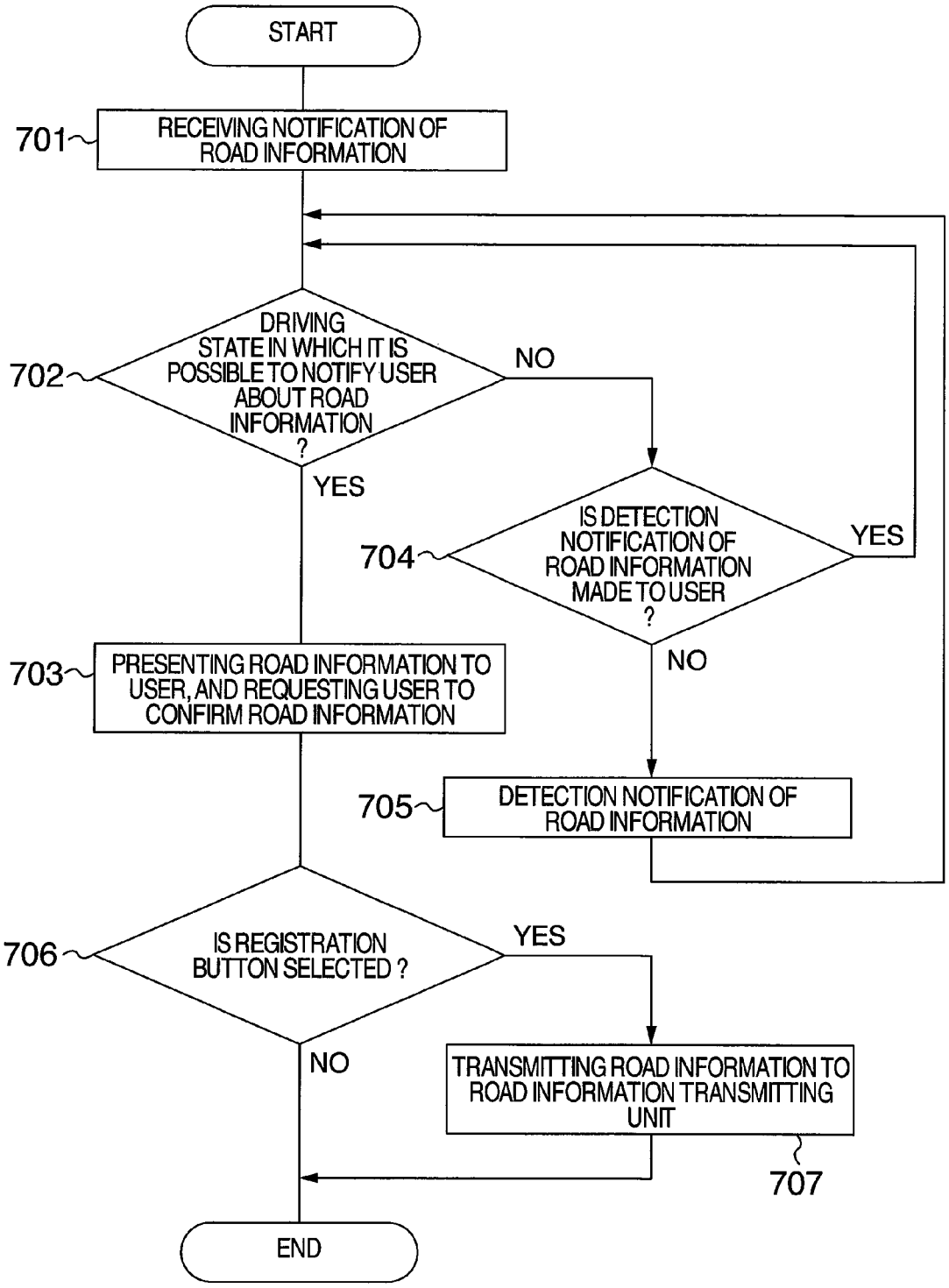
FIG. 7 illustrates the processing flow performed by a user notification unit according to the present embodiment.

FIG. 7 illustrates a processing flow performed by the user notification unit 108 of the terminal device 101. First of all, at a step 701, the user notification unit 108 receives the road information about which the unit 108 has been notified by the road information detecting unit 103. Next, at a step 702, the user notification unit 108 accesses the driving state estimating unit 105, thereby judging whether or not the driving state is a state in which it is allowable to prompt the user to confirm the road information. The driving states in which it is allowable to prompt the user to confirm the road information are defined in the driving state estimation-rules managing unit 106. Concretely, the driving state estimating unit 105 confirms whether or not all of the driving state estimation rules 404 stored into the driving state estimation-rules managing unit 106 are satisfied. For example, in the case of the estimation rule 404 of "waiting for signal change", the unit 105 acquires, from the sensor information accumulating unit 102, the "GPS position" information by the amount of 5 seconds, which is described in the sensor type 402 and sensor information acquisition time-period 403. Moreover, based on the GPS position information acquired, the unit 105 acquires, from the map information managing unit 107, the coordinate information on the "intersection point" in proximity to this GPS position. Then, the unit 105 judges whether or not the estimation rule 404 is satisfied. If the estimation rule 404 of "the position information remains unchanged in proximity to the intersection point during 5 seconds" is satisfied, the driving state is the "waiting for signal change", so that this driving state is judged to be the state in which it is allowable to prompt the user to confirm the road information. Meanwhile if the estimation rule 404 is not satisfied, the unit 105 confirms whether or not the next estimation rule is satisfied. If not a single estimation rule is satisfied, the driving states are judged to be states in which it is not allowable to prompt the user to confirm the road information. As a result of the above-described judgment made by the driving state estimating unit 105, if the driving state is the state in which it is allowable to prompt the user to confirm the road information (Yes), the user notification unit 108 proceeds to a step 703. Meanwhile, if the driving state is the state in which it is not allowable to prompt the user to confirm the road information (No), the unit 108 proceeds to a step 704.

Incidentally, if it is not allowable to prompt the user to confirm the road information immediately, it is necessary to wait for the driving state of the user to change to a state in which it is allowable to prompt the user to make this confirmation, and afterwards, it is necessary to request the user to make this confirmation. At the step 703, the user notification unit 108 presents the road information to the user, and requests the user to confirm the necessity/unnecessity of registration of the road information. This confirmation may be made to the user only by the image display, or may be made by the image and voice. Concrete examples of this image display will be explained using FIG. 8 and FIG. 9. At the step 704, if it is not allowable to prompt the user to confirm the road information, the unit 108 confirms whether or not the user has been already notified about the fact that the road information had been detected. The unit 108 returns to the step 702 if the user has been already notified (Yes); whereas, the unit 108 proceeds to a step 705 if the user has been not notified yet (No). At the step 705, the unit 108 notifies the user only about the fact that the road information had been detected. This is because it is not allowable to prompt the user to confirm the road information. In this way, the user is notified in advance about the fact that the road information had been detected, and the location at which the road information had been detected. This notification makes it possible to permit the user to make the confirmation easily after the driving state has changed to the state in which it is allowable to prompt the user to make the confirmation. In the driving state in which it is not allowable to prompt the user to confirm the road information, the user is driving the vehicle, and cannot watch the image. Consequently, the user is informed about the detection of the road information by a voice such as "Please register the new road later.", or a sound such as "peep".

Figure 8:
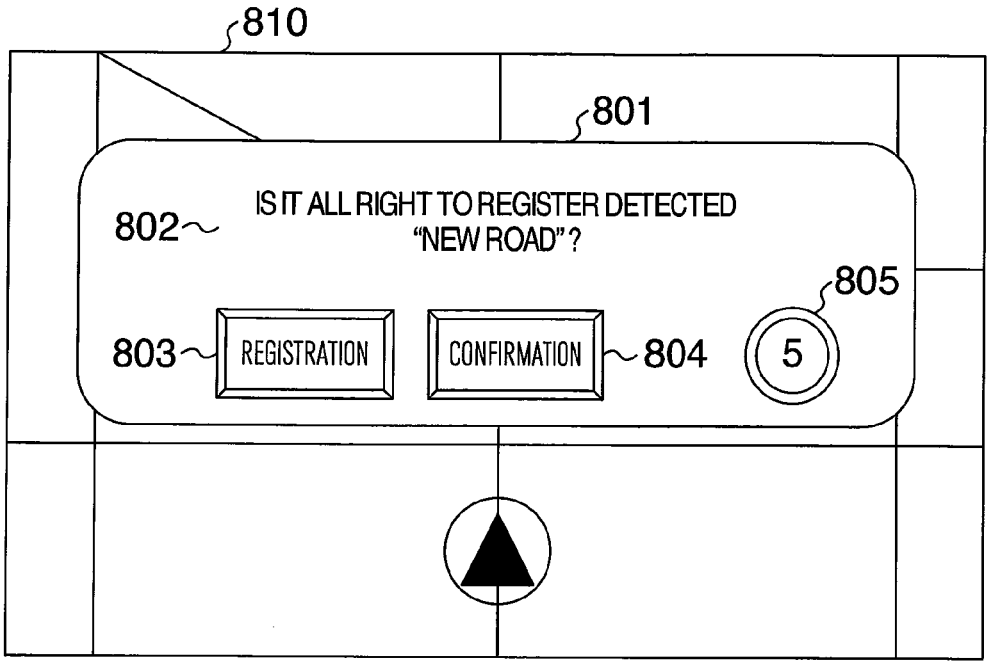
FIG. 8 illustrates a image example of the terminal device according to the present embodiment.

FIG. 8 illustrates an example of the image display of the terminal device 101 in the user notification unit 108. Concretely, FIG. 8 illustrates the image display's example in a case where a pop-up for confirming the road information is displayed when the navigation is operated in the terminal device 101. Namely, FIG. 8 illustrates the example where the pop-up 801 for confirming the road information is displayed on a navigation image 810. The pop-up 801 displays thereon a sentence 802 for prompting the registration of the road information, a registration button 803, a confirmation button 804, and a timer 805. The sentence 802 for prompting the registration of the road information describes therein the name (e.g., "new road") of the road information detected by the road information detecting unit 103. The registration button 803 is a button for registering the road information. The user's pushing down the registration button 803 causes the road information to be transmitted from the road information transmitting unit 109 to the center server 201.

The confirmation button 804 is a button for confirming the location at which the road information has occurred. The user's pushing down the confirmation button 804 causes the pop-up 801 to be temporarily non-displayed. Then, the location of the navigation image 810 moves to the location at which the road information has occurred. While the occurrence location of the road information is being displayed, instead of causing the pop-up 801 to be temporarily non-displayed, it is also allowable to make the pop-up 801 semi-transparent so that the map behind the pop-up 801 can be confirmed. Otherwise, it is also allowable to move the pop-up 801 to a not-disturbing location at an edge of the image. The timer 805 indicates a time that elapses until the pop-up 801 disappears. The timer 805 counts down gradually, and when it comes to "0", the pop-up 801 will disappear whatever operation the user does not perform. If the timer 805 comes to "0" while the user is performing an operation, it is also allowable to extinguish the pop-up 801. Otherwise, even if the timer 805 comes to "0" during the user's operation, it is also allowable not to extinguish the pop-up 801. Otherwise, it is also allowable to prohibit the pop-up 801 from counting down during the user's operation. Otherwise, even if the timer 805 counts down halfway, it is also allowable to cause the timer 805 to return to its value before the count-down (i.e., its initial value). Otherwise, it is also allowable to extinguish the pop-up 801, detecting that the driving state becomes the state in which it is not allowable to prompt the user to confirm the road information.

Figure 9:
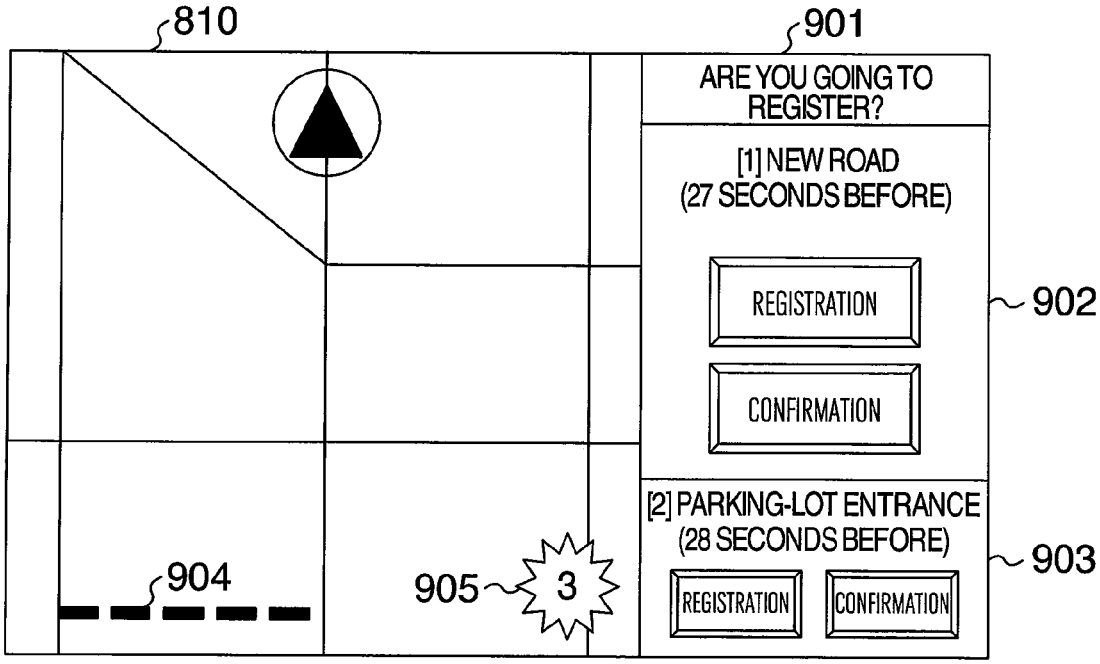
FIG. 9 illustrates another image example of the terminal device according to the present embodiment.

FIG. 9 illustrates another example of the image display of the terminal device 101 in the user notification unit 108. FIG. 8 illustrated the image display's example where the user is requested to confirm the road information by the pop-up 801. In contrast thereto, FIG. 9 illustrates the image display's example where the user is requested to confirm the road information by dividing the image. Namely, the image display of the terminal device 101 is divided into the navigation image 810 and a confirmation image 901 of the road information. The road-information confirmation image 901 displays road information 902 of first candidate and road information 903 of second candidate. Each of the candidates displays thereon type, occurrence point-in-time, a registration button, and an occurrence-location confirmation button of the road information detected. For example, in the road information 902 of the first candidate, "new road" and "27 seconds before" are displayed as the detected road information and the occurrence point-in-time, respectively.

The navigation image 810 displays the image display's example in a case where the road information 902 of the first candidate is pushed down. In the navigation image 810, the occurrence location 904 of the new road is displayed on the map. The detection number 905 of the road information is displayed together therewith. The detection number 905 of the image display's example indicates that three pieces of road information are detected. Although only the two candidates are displayed in the image display's example, three or more candidates may be displayed. With regard to the arrangement order, the candidates may be arranged in an order ranging from the newest occurrence point-in-time to the oldest one; or in an order ranging from the oldest occurrence point-in-time to the newest one; or the candidates may be arranged in a manner of being sorted for each type of the road information; or the candidates may be arranged in an order ranging from the occurrence location closest to the present location.

Also, it is also allowable to display plural pieces of road information in a manner of being limited to the road information that have occurred within a certain time (such as, e.g., within 3 minutes). Otherwise, it is also allowable to display the plural pieces of road information in a manner of being limited to the road information of a specific type or types (such as, e.g., new road alone, or new road and byroad). In the image display's example, the first candidate is displayed in a larger font size and with larger buttons as compared with the second candidate, so that the user can confirm them easily. It is also allowable to display the navigation image 810 and the road-information confirmation image 901 in the state of being always divided to each other. Otherwise, it is also allowable to perform the division display, detecting that the driving state becomes the state in which it is allowable to prompt the user to confirm the road information. Otherwise, it is also allowable to perform the division display, detecting that the user touches the road-information detection number 905. Moreover, it is also allowable to release the division of the divided image with a lapse of a constant time, and to permit the image display to return to the navigation image 810 alone. Otherwise, it is also allowable to release the division if the user operation is absent during a constant time. Otherwise, it is also allowable to release the division, detecting that the driving state becomes the state in which it is not allowable to prompt the user to confirm the road information.

Incidentally, in the present embodiment, the road information detecting unit 103, the road information detection-rules managing unit 104, the driving state estimating unit 105, the driving state estimation-rules managing unit 106, and the map information managing unit 107 are stored into the terminal device 101. It is also allowable, however, to implement a configuration that these units are stored into the storage unit of the center server 201. The explanation of the configurations that overlap with the above-described embodiment will be omitted. In this case, the sensor information is acquired from the sensor information accumulating unit 102 where the respective types of sensor information are accumulated. Moreover, based on the sensor information acquired, the matching between the road information and the road information detection rules is executed on the side of the center server 201. As a result of the matching, if the road information coincides with any one of the road information detection rules memorized in the road information detection-rules managing unit 104, this road information is transmitted to the terminal device 101. Furthermore, in accordance with the driving state estimation rules, this road information is presented to the user by the user notification unit 108. As a result of this presentation, if the registration button is selected, this road information is accumulated into the road information accumulating unit 203 via the road information receiving unit 202 of the center server 201. By employing this configuration, it becomes possible to reduce the load imposed on the processing capability in the terminal device 101.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A road information sharing method in a road information sharing system for sharing road information, comprising:

storing sensor information acquired from a terminal device or a vehicle moving in accompaniment with said terminal device;

detecting said road information from said sensor information based on detection rules for detecting said road information;

estimating a driving state of said vehicle from said sensor information based on estimation rules for estimating said driving state of said vehicle moving in accompaniment with said terminal device;

judging whether or not said estimated driving state is a state in which it is allowable to prompt a user to make a judgment of necessity/unnecessity of registration of said detected road information based on said driving state;

notifying said user about said detected road information;

when said driving state is said state in which it is allowable to prompt said user, prompting said user to make said judgment of necessity/unnecessity of registration about said detected road information;

when said driving state is not said state in which it is allowable to prompt said user, waiting for said driving state to become said state in which it is allowable to prompt said user to make said judgment of necessity/unnecessity of registration, and then prompting said user to make said judgment of necessity/unnecessity of registration; and when said detected road information is judged to be registration necessary by said user, storing said detected road information or outputting said detected road information to an external device, wherein said notification to said user is executed a plurality of times including a first time of notifying said user about said detected road information using a sound and a second time of notifying said user about said detected road information using a pop-up or image information for prompting said user to make said judgment of necessity/unnecessity of registration about said detected road information.

2. The road information sharing method according to claim 1, further comprising:

when driving state is not said state in which it is allowable to prompt said user to make said judgment of necessity/unnecessity of registration, notifying said user that said user will be prompted to make said judgment of necessity/unnecessity of registration at a later time.

3. The road information sharing method according to claim 1, wherein whether or not said estimated driving state is said state in which it is allowable to prompt said user to make said judgment of necessity/unnecessity of registration of said detected road information is judged based on said driving state, said stored sensor information and map information.

4. A road information sharing method in a road information sharing system for sharing road information, comprising the steps of:

storing sensor information acquired from a terminal device or a vehicle moving in accompaniment with said terminal device;

detecting said road information from said sensor information based on detection rules for detecting said road information;

estimating a driving state of said vehicle from said sensor information based on estimation rules for estimating said driving state of said vehicle moving in accompaniment with said terminal device;

judging whether or not said estimated driving state is a state in which it is allowable to prompt a user to make a judgment of necessity/unnecessity of registration of said detected road information based on said driving state;

notifying said user about said road information detected;

when said driving state is said state in which it is allowable to prompt said user, prompting said user to make said judgment of necessity/unnecessity of registration about said detected road information by displaying an image; and when said detected road information is judged to be registration necessary by said user, storing said detected road information or outputting said detected road information to an external device, wherein, when said driving state changes from said state in which it is allowable to prompt said user to make said judgment of necessity/unnecessity of registration to said state in which it should not be performed to prompt said user to make said judgment of necessity/unnecessity of registration, said image is controlled so as not to be displayed.

5. The road information sharing method according to claim 4, further comprising:

when said driving state is not said state in which it is allowable to prompt said user to make said judgment of necessity/unnecessity of registration, waiting for said driving state to become said state in which it is allowable to prompt said user to make said judgment of necessity/unnecessity of registration, and then prompting said user to make said judgment of necessity/unnecessity of registration.

6. The road information sharing method according to claim 5, wherein said notification to said user is executed a plurality of times including a first time of notifying said user about said detected road information using a sound and a second time of notifying said user about said detected road information using a pop-up or image information for prompting said user to make said judgment of necessity/unnecessity of registration about said detected road information.

7. The road information sharing method according to claim 4, further comprising:

when said driving state is not said state in which it is allowable to prompt said user to make said judgment of necessity/unnecessity of registration, notifying said user that said user will be prompted to make said judgment of necessity/unnecessity of registration at a later time.

8. The road information sharing method according to claim 4, wherein whether or not said estimated driving state is said state in which it is allowable to prompt said user to make said judgment of necessity/unnecessity of registration of said detected road information is judged based on said driving state, said stored sensor information and map information.

9. A road information sharing method in a road information sharing system for sharing road information, comprising the steps of:

storing sensor information acquired from a terminal device or a vehicle moving in accompaniment with said terminal device;

detecting said road information from said sensor information based on detection rules for detecting said road information;

notifying a user about said road information detected, and prompting said user to make a judgment of necessity/unnecessity of registration about said detected road information; and storing said detected road information, or outputting said detected road information to an external device, if said detected road information is judged to be registration necessary by said user, wherein, when said road information is detected as plural pieces of road information, said user is notified about said detected plural pieces of road information in accordance with priority degrees being assigned based on respective detection points-in-time or respective distances between detection locations and a present position.

10. The road information sharing method according to claim 9, further comprising:

estimating a driving state of said vehicle from said sensor information based on estimation rules for estimating said driving state of said vehicle moving in accompaniment with said terminal device; and judging whether or not said estimated driving state is a state in which it is allowable to prompt said user to make a judgment of necessity/unnecessity of registration of said detected road information based on said driving state.

11. The road information sharing method according to claim 10, further comprising:

when driving state is said state in which it is allowable to prompt said user to make said judgment of necessity/unnecessity of registration, prompting said user to make said judgment of necessity/unnecessity of registration about said detected road information; and when said driving state is not said state in which it is allowable to prompt said user to make said judgment of necessity/unnecessity of registration, waiting for said driving state to become said state in which it is allowable to prompt said user to make said judgment of necessity/unnecessity of registration, and then prompting said user to make said judgment of necessity/unnecessity of registration.

12. The road information sharing method according to claim 11, wherein said notification to said user is executed a plurality of times including a first time of notifying said user about said detected road information using a sound and a second time of notifying said user about said detected road information using a pop-up or image information for prompting said user to make said judgment of necessity/unnecessity of registration about said detected road information.

13. The road information sharing method according to claim 10, further comprising:

when said driving state is judged not to be said state in which it is allowable to prompt said user to make said judgment of necessity/unnecessity of registration, notifying said user that said user will be prompted to make said judgment of necessity/unnecessity of registration at a later time.

14. The road information sharing method according to claim 10, wherein whether or not said estimated driving state is said state in which it is allowable to prompt said user to make said judgment of necessity/unnecessity of registration of said detected road information is judged based on said driving state, said stored sensor information and map information.

* * * * *